US010074526B2

(12) United States Patent
Bonner et al.

(10) Patent No.: US 10,074,526 B2
(45) **Date of Patent: *Sep. 11, 2018**

(54) SYSTEMS AND METHODS FOR RAPIDLY SCREENING SAMPLES BY MASS SPECTROMETRY

(71) Applicant: DH Technologies Development Pte. Ltd., Singapore (SG)

(72) Inventors: Ronald F. Bonner, Newmarket (CA); Stephen A. Tate, Barrie (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/367,481

(22) Filed: Dec. 2, 2016

(65) Prior Publication Data

US 2017/0084436 A1 Mar. 23, 2017

Related U.S. Application Data

(63) Continuation of application No. 14/944,467, filed on Nov. 18, 2015, now Pat. No. 9,543,134, which is a continuation of application No. 13/876,349, filed as application No. PCT/IB2011/002594 on Nov. 2, 2011, now Pat. No. 9,269,553.

(60) Provisional application No. 61/411,028, filed on Nov. 8, 2010.

(51) Int. Cl.
*H01J 49/04* (2006.01)
*H01J 49/00* (2006.01)

(52) U.S. Cl.
CPC ..... *H01J 49/0045* (2013.01); *H01J 49/0027* (2013.01); *H01J 49/0031* (2013.01); *H01J 49/04* (2013.01)

(58) Field of Classification Search
USPC ..... 250/282
See application file for complete search history.

(56) References Cited

U.S. PATENT DOCUMENTS 6,582,965 B1 * 6/2003 Townsend ..... G01N 33/6818 250/282
6,900,430 B2 * 5/2005 Okumura ..... H01J 49/401 250/281
7,145,133 B2 * 12/2006 Thomson ..... H01J 49/0081 250/281

(Continued)

*Primary Examiner* — Phillip A Johnston
(74) *Attorney, Agent, or Firm* — John R. Kasha; Kelly L. Kasha; Kasha Law LLC

(57) ABSTRACT

Systems and methods are used to rapidly screening samples. A fast sample introduction device that is non-chromatographic is instructed to supply each sample of a plurality samples to a tandem mass spectrometer using a processor. The fast sample introduction device can include a flow injection analysis device, an ion mobility analysis device, or a rapid sample cleanup device. The tandem mass spectrometer is instructed to perform fragmentation scans at two or more mass selection windows across a mass range of each sample of the plurality of samples using the processor. The two or more mass selection windows across the mass range can have fixed or variable window widths. The tandem mass spectrometer can be instructed to obtain a mass spectrum of the mass range before instructing the tandem mass spectrometer to perform the fragmentation scans.

11 Claims, 4 Drawing Sheets

(56) References Cited

U.S. PATENT DOCUMENTS

| | | | | |
|---|---|---|---|---|
| 7,676,329 | B2 * | 3/2010 | Garczarek | G01N 30/8624 702/19 |
| 8,481,924 | B2 * | 7/2013 | Savitski | H01J 49/0045 250/281 |
| 8,620,588 | B2 * | 12/2013 | May | G01N 33/6848 702/19 |
| 2011/0127419 | A1 * | 6/2011 | Thomson | H01J 49/004 250/282 |

* cited by examiner

SYSTEMS AND METHODS FOR RAPIDLY SCREENING SAMPLES BY MASS SPECTROMETRY

CROSS-REFERENCE TO RELATED APPLICATION

This application is a continuation of U.S. patent application Ser. No. 14/944,467, filed Nov. 18, 2015, which is a continuation of U.S. patent application Ser. No. 13/876,349, filed Mar. 27, 2013, filed as Application No. PCT/IB2011/002594 on Nov. 2, 2011, now U.S. Pat. No. 9,269,553, which claims the benefit of U.S. Provisional Patent Application No. 61/411,028, filed Nov. 8, 2010, the disclosures of which are incorporated by reference herein in their entireties.

INTRODUCTION

In many applications there is a need for rapid analyses, either because there are many samples to be run or the results are required quickly. Applications that require many samples include, but are not limited to, drug screening, drug discovery metabolism, network biology and biological experiments, food analyses, process monitoring, DNA analyses for forensics, and small interfering RNA (siRNA) screening. Applications that require results to be returned quickly include, but are not limited to, diagnosis, drug doping, food analyses, and therapeutic monitoring.

One method of providing rapid sample analysis couples a fast separation technique with a traditional high resolution mass spectrometry method. For example, samples are infused into the system at a high sample rate. One high resolution mass spectrum is produced for each sample. The spectra of different samples are then compared.

Although this method can identify obvious differences in small and large molecules between samples, very few of these difference may be indicative of items of interest such as disease. Finally, using this method, subtle but important differences may be lost or hidden due to additional complications that can include, but are not limited to, ion suppression, unresolved isomers, matrix effects, or isobaric species.

BRIEF DESCRIPTION OF THE DRAWINGS

The skilled artisan will understand that the drawings, described below, are for illustration purposes only. The drawings are not intended to limit the scope of the present teachings in any way.

Figure 1:
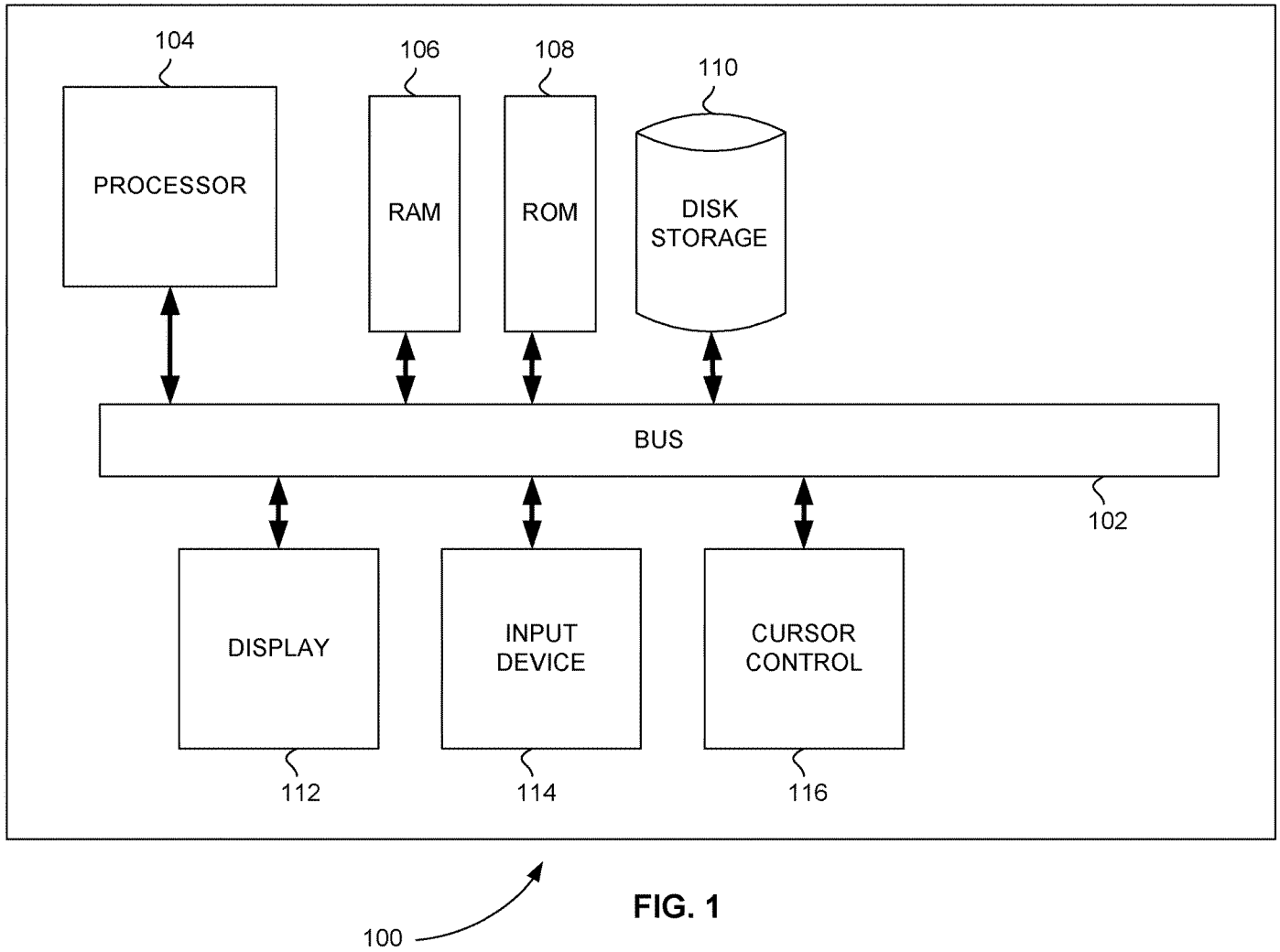
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods of Data Processing

As described above, rapid sample analysis is useful in increasing sample throughput or in producing required results quickly. Traditional methods of providing rapid sample analysis have included coupling a fast separation technique with high resolution mass spectrometry (MS). Such methods are often unable to reveal complexities in the results caused by complications that can include, but are not limited to, ion suppression, unresolved isomers, matrix effects, or isobaric species. Another traditional method is to use a fast separation technique to introduce the sample, rapidly generate a MS scan and then perform tandem mass spectrometry, or mass spectrometry/mass spectrometry (MS/MS), on selected ions identified in the MS spectrum. In order to maintain high throughput only a limited number of MS/MS spectra can be acquired in this way.

In various embodiments, a fast sample introduction technique that is non-chromatographic is coupled with a tandem mass spectrometry technique that performs fragmentation scans at two or more mass selection windows across an entire mass range of interest to provide a rapid sample analysis method. This method can provide enough MS/MS information to produce meaningful results and can reveal important complexities in the results.

A fast sample introduction technique that is non-chromatographic can include, but is not limited to, flow injection analysis (FIA), mobility analysis, or a rapid sample cleanup technique. A rapid sample cleanup technique can include, for example, a trap and elute technique. A fast sample introduction technique can inject samples for tandem mass spectrometry analysis at a rate or frequency of approximately one sample per minute, for example.

Tandem mass spectrometry is used to reveal complexities in the data between different samples. For example, tandem mass spectrometry can resolve isomers. Nothing in a single mass spectrum reveals that isomers of the same mass are present. However, fragmenting those isomers can reveal that there are differences between samples at different masses, because the fragments from a mass in one sample can be slightly different from the fragments from the same mass in another sample.

The specificity of a method performed on a tandem mass spectrometer is improved by providing the mass analyzer with a narrow mass selection window width, or precursor mass selection window width. A narrow mass selection window width is on the order of 1 atomic mass unit (amu), for example. Alternatively, the sensitivity of the method is improved by providing the mass analyzer with a wide mass selection window width. A wide mass selection window width is on the order of 20 or 200 amu, for example.

In various embodiments, a mass selection window width with sufficient sensitivity is selected for the first mass analysis stage of a tandem mass spectrometer in a rapid sample analysis method. Moving this mass selection window width allows an entire mass range to be fragmented within a short period of time and without the need to determine which masses to fragment.

Selecting a wider mass selection window requires fewer fragmentation scans to cover a mass range. For example, a mass range from 200 amu to 600 that is scanned using a narrow mass selection window width of 1 amu requires 400 fragmentation scans. Using a wider mass selection window width of 100 amu requires just 4 fragmentation scans. A wider mass selection window is, therefore, used to fragment samples across the entire mass range of interest in order to analyze samples at the rate samples are injected by the fast sample introduction technique.

As described above, selecting a wider mass selection window provides greater sensitivity and less specificity than selecting a narrower mass selection for the first stage of tandem mass spectrometry. However, any loss in specificity can be regained through high resolution detection in the second stage of tandem mass spectrometry. As a result, both high specificity and high sensitivity can be provided by the overall method.

In various embodiments, fragmentation scans occur at uniform or fixed mass selection windows across a mass range. The mass range can include, for example, a preferred mass range of the sample or the entire mass range of the sample.

Recent developments in mass spectrometry hardware have allowed the mass selection window width of a tandem mass spectrometer to be varied or set to any value instead of a single value across a mass range. For example, independent control of both the radio frequency (RF) and direct current (DC) voltages applied to a quadrupole mass filter or analyzer can allow the selection of variable mass selection window widths. Any type of tandem mass spectrometer can allow the selection of variable mass selection window widths. A tandem mass spectrometer can include one or more physical mass analyzers that perform two or more mass analyses. A mass analyzer of a tandem mass spectrometer can include, but is not limited to, a time-of-flight (TOF), quadrupole, an ion trap, a linear ion trap, an orbitrap, or a Fourier transform mass spectrometer.

In various embodiments, fragmentation scans occur with variable mass selection windows across a mass range. Varying the value of the mass selection window width across a mass range of an analysis can improve both the specificity, sensitivity, and speed of the analysis. For example, in areas of the mass range where compounds are known to exist, a narrow mass selection window width is used. This enhances the specificity of the known compounds. In areas of the mass range where no compounds are known to exist, a wide mass selection window width is used. This allows unknown compounds to be found, thereby improving the sensitivity of the analysis. The combination of wide and narrow ranges allows a scan to be completed faster than using fixed narrow windows.

Also, by using narrow mass selection window widths in certain areas of the mass range, other mass peaks in a mass spectrum are less likely to affect the analysis of the mass peaks of interest. Some of the effects that can be caused by other mass peaks can include, but are not limited to, saturation, ion suppression, or space charge effects.

In various embodiments, the value of the mass selection window width chosen for a portion of the mass range is based on information known about the samples. In other words, the value of the mass selection window width is adjusted across the mass range based on the known or expected complexities of the samples. So, where the samples are more complex or have a large number of ions, narrower mass selection window widths are used, and where the samples are less complex or have a sparse number of ions, wider mass selection window widths are used. The complexity of the samples can be determined by creating a compound molecular weight profile of the samples, for example.

A compound molecular weight profile of the samples can be created in a number of ways. In addition, the compound molecular weight profile of the samples can be created before data acquisition or during data acquisition. Further, the compound molecular weight profile of the samples can be created in real-time during data acquisition.

In various embodiments, the compound molecular weight profile used to define variable window widths across a mass range is preferably created before data acquisition and used for all samples analyzed with a rapid sample analysis method. Not varying the variable window widths between samples allows differences between samples to be more easily found.

Other parameters of a tandem mass spectrometer are dependent on the mass selection window widths that are selected across a mass range. These other parameters can include ion optical elements, such as collision energy, or non-ion optical elements, such as accumulation time, for example.

As a result, in various embodiments, the analysis of samples can further include varying one or more parameters of the tandem mass spectrometer other than the mass selection window width across a mass range. Varying such parameters can reduce the unwanted effects of the additional complications described above. For example, through the fragmentation of windowed regions that do not appear to have a precursor ion present, and by varying the accumulation time for these windows, the potential effects of matrix suppression can be mitigated to some extent.

In various embodiments, one or more samples can be analyzed before the subsequent analysis that uses fixed or variable mass selection window widths. This analysis of the samples can include a complete analysis or a single scan. A complete analysis includes, for example, two or more scans. A scan can be, but is not limited to, a survey scan, a neutral loss scan, or a precursor scan. A scan can provide, for example, a high resolution mass spectrometry (HRMS) spectrum. An HRMS spectrum can be used to determine the accurate mass of precursor ions, or to determine the mass distribution of precursor ions in the one or more samples to define the window widths, for example.

An HRMS spectrum can be used as a fingerprint of a sample. In some cases, comparing fingerprints may already indicate differences that would be the targets of a method of fragmenting all precursor ions in windows across a mass range, while in others the fingerprint can be used to determine the window widths and accumulation times. This could be based on the peak density (areas with more peaks get narrower windows) or the peak intensity (large peaks get narrow windows and short accumulation times while other areas get longer times with windows based on peak density), for example.

After a rapid sample analysis method, data is mined for information of interest and stored for comparison with other samples or for re-analysis, for example. Data mining is extremely fast allowing many samples to be run, for example for network biology experiments or high throughput screening (HTS), or to provide rapid turnaround of the results. The information content of an assay is also very high allowing two-dimensional (2D) maps to be generated from a sample. Data mining tools and techniques can include, but are not limited to, (1) libraries of expected compounds which can be used to perform library searches and to generate ion traces or ion profiles, (2) extraction techniques which would allow the isolation of masses determined by the potential neutral losses which can be seen, and (3) the use of image manipulation or other techniques for the identification of similarities and differences in samples.

Additional levels of information can also be extracted from a rapid sample analysis method. For example, in many cases it is possible to perform several scans at different collision energies so that there is additional information for identification (the breakdown curves of the compounds) or deconvolution. For example, the MS/MS spectra of compounds can be found by correlation across multiple samples, i.e., the fragments that have the same behavior across many samples are probably from the same compound. Deconvolution involves deconvoluting the spectra of compounds by correlation.

Sample preparation is another important aspect of a rapid sample analysis method. Sample preparation, especially fractionation, is needed to separate compound classes, so the appropriate windows and analytical conditions can be applied. Pre-concentration of a sample is also potentially required, for example via solid phase extraction, so concentrations can be increased to detectable levels. The amount of sample preparation needed is dependent on the sample complexity and the required sensitivity and compound coverage. In some applications, it is minimal and in others very extensive. However, sample preparation can be performed in an off-line and automated manner so that actual analysis speed is maintained.

In various embodiments, a rapid sample analysis method can significantly enable network biology by allowing thousands of samples to be analyzed in a reasonable time scale. Large scale automated sample preparation is used to fractionate the sample (perhaps 1 mL of serum or plasma) into compound classes (small polar molecules such as sugars, nucleosides, amino acids, organic acids; lipids; peptides;

proteins; miRNA . . . ) prior to analysis. A similar approach is used for characterizing commercial products (small and large therapeutics, e.g.), foods, etc.

Tandem Mass Spectrometry System

Figure 2:
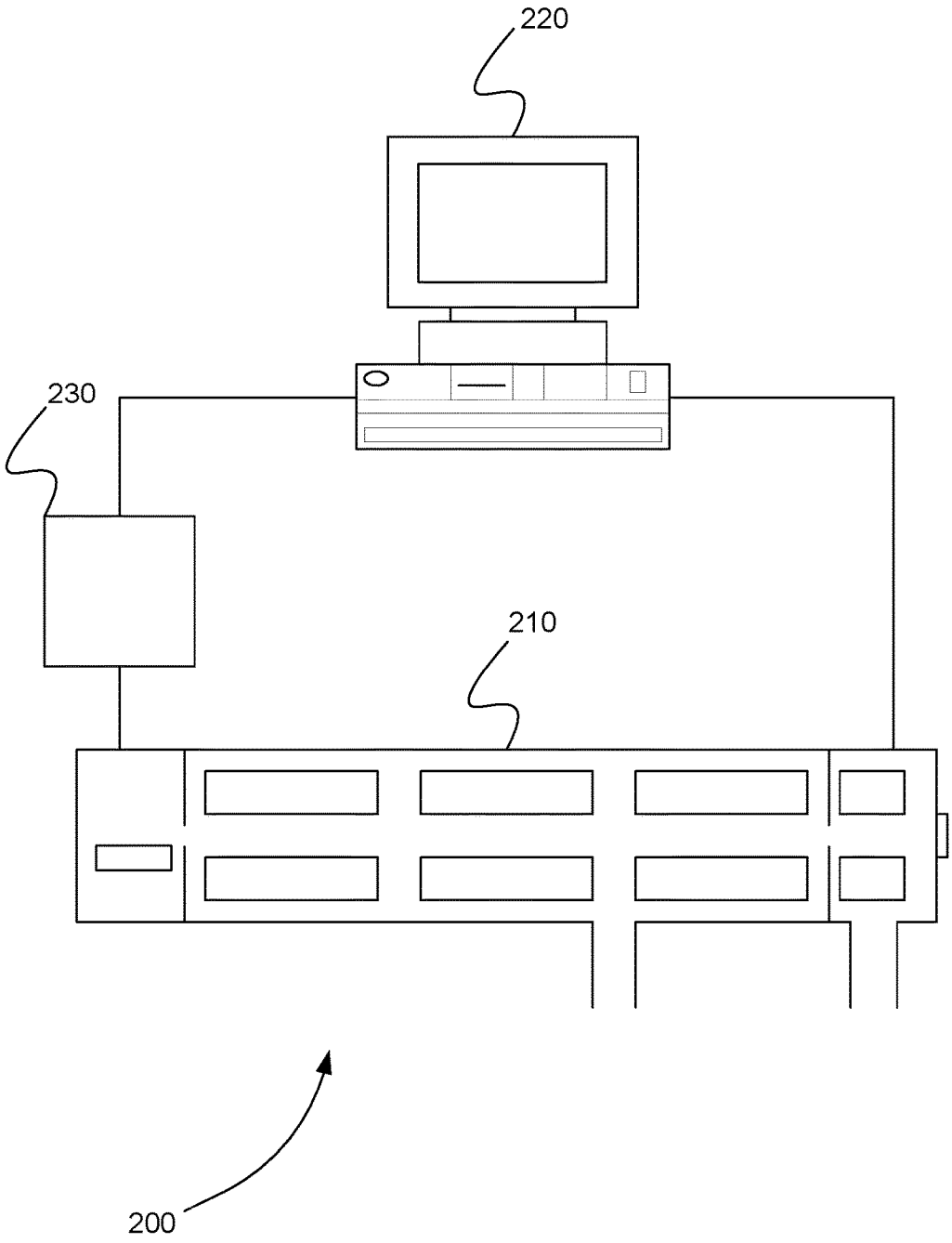
FIG. 2 is a schematic diagram showing a system for rapidly screening samples, in accordance with various embodiments.

FIG. 2 is a schematic diagram showing a system 200 for rapidly screening samples, in accordance with various embodiments. System 200 includes tandem mass spectrometer 210, processor 220, and fast sample introduction device 230. Processor 220 can be, but is not limited to, a computer, microprocessor, or any device capable of sending and receiving control signals and data to and from mass spectrometer 210 and fast sample introduction device 230 and processing data.

Tandem mass spectrometer 210 can include can include one or more physical mass analyzers that perform two or more mass analyses. A mass analyzer of a tandem mass spectrometer can include, but is not limited to, a time-of-flight (TOF), quadrupole, an ion trap, a linear ion trap, an orbitrap, or a Fourier transform mass analyzer. Tandem mass spectrometer 210 can include separate mass spectrometry stages or steps in space or time, respectively.

Fast sample introduction device 230 can perform a fast sample introduction technique that is non-chromatographic and that includes, but is not limited to, FIA, ion mobility analysis, or a rapid sample cleanup technique. Fast sample introduction device 230 can be part of tandem mass spectrometer 210 or it can be a separate device as shown in system 200. Fast sample introduction device 230 supplies tandem mass spectrometer 210 with each sample of a plurality of samples.

Processor 220 is in communication with the tandem mass spectrometer 210 and fast sample introduction device 230. Processor 220 instructs fast sample introduction device 230 to supply each sample of the plurality of samples to tandem mass spectrometer 210. Processor 220 then instructs tandem mass spectrometer 210 to perform fragmentation scans at two or more mass selection windows across an entire mass range of interest of each sample. The two or more mass selection windows are adjacent mass selection windows, for example.

In various embodiments, the two or more mass selection windows used across the mass range have a fixed window width. In various embodiments, at least two of the two or more mass selection windows used across the mass range have different window widths.

In various embodiments, processor 220 instructs tandem mass spectrometer 210 to obtain a mass spectrum of the mass range before processor 220 instructs the tandem mass spectrometer to perform the fragmentation scans.

In various embodiments, processor 220 instructs tandem mass spectrometer 210 to vary at least one parameter of tandem mass spectrometer 210 between at least two of the two or more mass selection windows used across the mass range.

Tandem Mass Spectrometry Method

Figure 3:
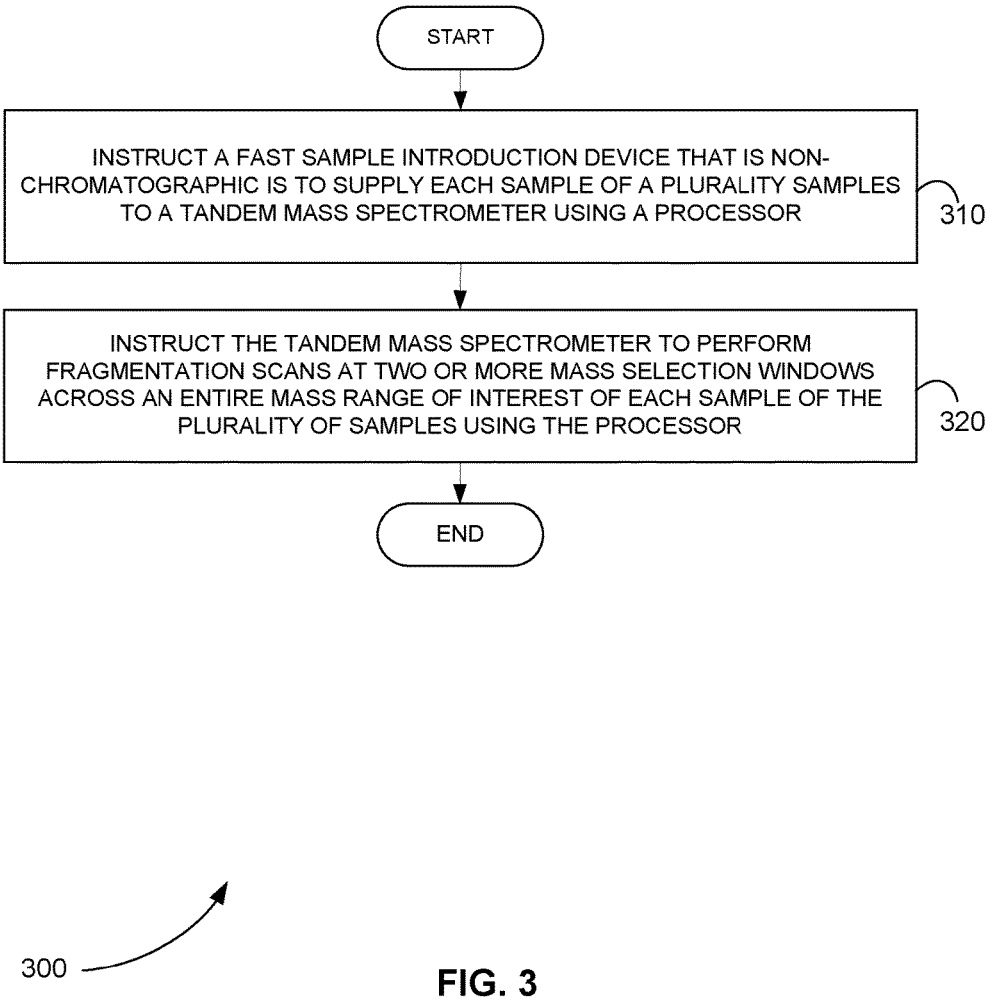
FIG. 3 is an exemplary flowchart showing a method for rapidly screening samples, in accordance with various embodiments.

FIG. 3 is an exemplary flowchart showing a method 300 for rapidly screening samples, in accordance with various embodiments.

In step 310 of method 300, a fast sample introduction device that is non-chromatographic is instructed to supply each sample of a plurality samples to a tandem mass spectrometer using a processor.

In step 320, the tandem mass spectrometer is instructed to perform fragmentation scans at two or more mass selection windows across an entire mass range of interest of each sample of the plurality of samples using the processor.

Tandem Mass Spectrometry Computer Program Product

In various embodiments, a computer program product includes a non-transitory and tangible computer-readable storage medium whose contents include a program with instructions being executed on a processor so as to perform a method for rapidly screening samples. This method is performed by a system that includes one or more distinct software modules.

Figure 4:
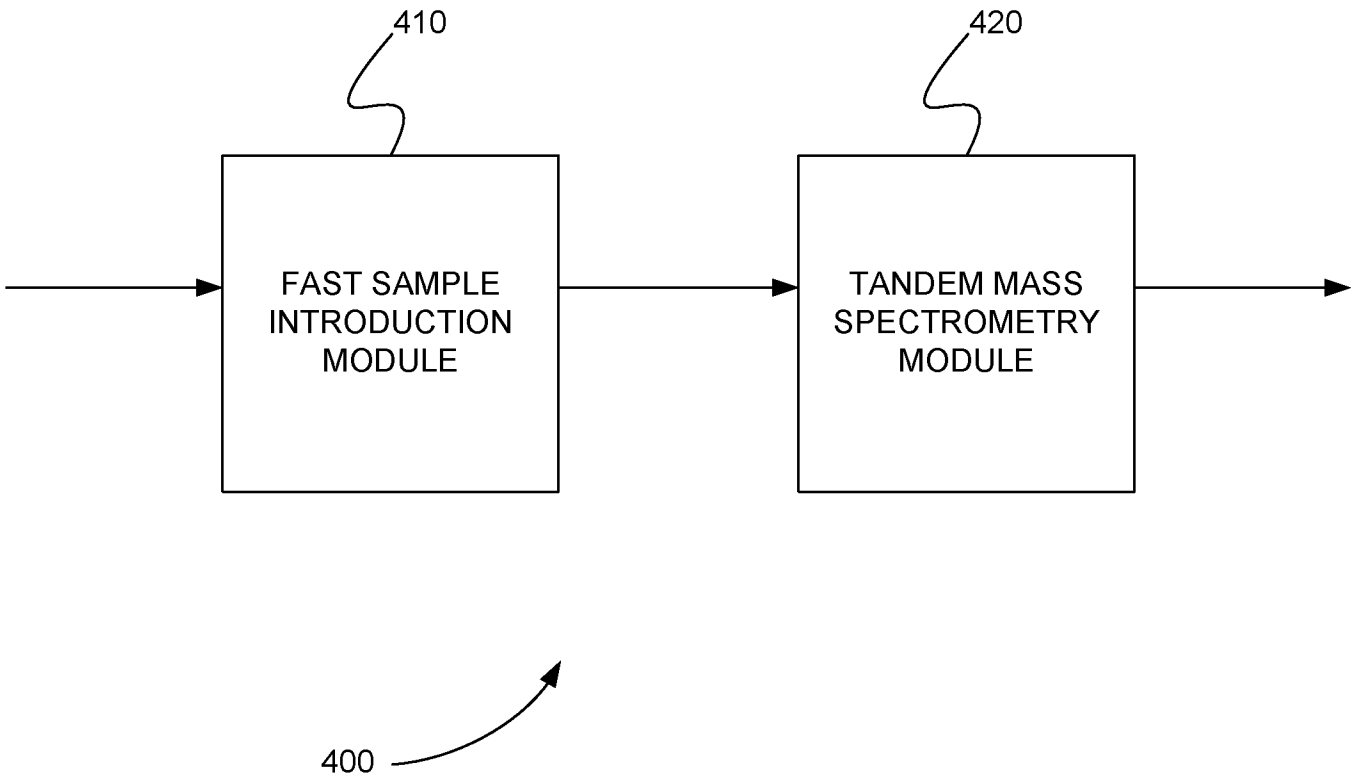
FIG. 4 is a schematic diagram of a system that includes one or more distinct software modules that performs a method for rapidly screening samples, in accordance with various embodiments.

FIG. 4 is a schematic diagram of a system 400 that includes one or more distinct software modules that performs a method for rapidly screening samples, in accordance with various embodiments. System 400 includes fast sample introduction module 410 and tandem mass spectrometry module 420.

Fast sample introduction module 410 instructs a fast sample introduction device that is non-chromatographic to supply each sample of a plurality samples to a tandem mass spectrometer. Tandem mass spectrometry module 420 instructs the tandem mass spectrometer to perform fragmentation scans at two or more mass selection windows across an entire mass range of interest of each sample of the plurality of sample.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for rapidly screening samples, comprising:

a tandem mass spectrometer that includes a quadrupole mass filter that allows independent control of both the radio frequency (RF) voltages and direct current (DC) voltages;

a fast sample introduction device that is non-chromatographic and that supplies the tandem mass spectrometer with each sample of a plurality of samples; and a processor in communication with the tandem mass spectrometer and the fast sample introduction device that instructs the tandem mass spectrometer to perform a survey scan of the each sample supplied by the fast sample introduction device to obtain a precursor mass spectrum, determines a mass distribution of precursor ions in the each sample from the precursor mass spectrum to define two or more adjacent wide precursor mass selection windows across an entire mass range of interest of the each sample, wherein at least two of the two or more adjacent wide precursor mass selection windows have different window widths, and instructs the tandem mass spectrometer to perform fragmentation scans at the two or more adjacent wide precursor mass selection windows across the entire mass range of interest of the each sample by independently controlling the RF voltages and DC voltages of the quadrupole mass filter of the tandem mass spectrometer.

2. The system of claim 1, wherein the fast sample introduction device comprises a flow injection analysis device, an ion mobility analysis device, or a rapid sample cleanup device.

3. The system of claim 1, wherein the processor instructs the tandem mass spectrometer to vary at least one parameter of the tandem mass spectrometer between at least two of the two or more adjacent wide precursor mass selection windows.

4. The system of claim 1, wherein the processor instructs the fast sample introduction device to supply the each sample to the tandem mass spectrometer before the processor instructs the tandem mass spectrometer to perform the survey scan of the each sample to obtain a precursor mass spectrum.

5. The system of claim 1, wherein the plurality of samples are injected by the fast sample introduction device.

6. A method for rapidly screening samples, comprising:

instructing a fast sample introduction device that is non-chromatographic to supply each sample of a plurality samples to a tandem mass spectrometer using a processor, wherein the tandem mass spectrometer includes a quadrupole mass filter that allows independent control of both the radio frequency (RF) voltages and direct current (DC) voltages;

instructing the tandem mass spectrometer to perform a survey scan of the each sample supplied by the fast sample introduction device to obtain a precursor mass spectrum using the processor;

determining a mass distribution of precursor ions in the each sample from the precursor mass spectrum to define two or more adjacent wide precursor mass selection windows across an entire mass range of interest of the each sample using the processor, wherein at least two of the two or more adjacent wide precursor mass selection windows have different window widths; and instructing the tandem mass spectrometer to perform fragmentation scans at the two or more adjacent wide precursor mass selection windows across the entire mass range of interest of the each sample by independently controlling the RF voltages and DC voltages of the quadrupole mass filter of the tandem mass spectrometer using the processor.

7. The method of claim 6, further comprising instructing the tandem mass spectrometer to vary at least one parameter of the tandem mass spectrometer between at least two of the two or more adjacent wide precursor mass selection windows using the processor.

8. The method of claim 6, wherein the plurality of samples are injected by the fast sample introduction device.

9. A computer program product, comprising a non-transitory and tangible computer-readable storage medium whose contents include a program with instructions being executed on a processor so as to perform a method for rapidly screening samples, the method comprising:

providing a system, wherein the system comprises one or more distinct software modules, and wherein the distinct software modules comprise a fast sample introduction module and a tandem mass spectrometry module, wherein the tandem mass spectrometer includes a quadrupole mass filter that allows independent control of both the radio frequency (RF) voltages and direct current (DC) voltages;

instructing a fast sample introduction device that is non-chromatographic to supply each sample of a plurality samples to a tandem mass spectrometer using the fast sample introduction module;

instructing the tandem mass spectrometer to perform a survey scan of the each sample supplied by the fast sample introduction device to obtain a precursor mass spectrum using the tandem mass spectrometry module;

determining a mass distribution of precursor ions in the each sample from the precursor mass spectrum to define two or more adjacent wide precursor mass selection windows across an entire mass range of interest of the each sample using the tandem mass spectrometry module, wherein at least two of the two or more adjacent wide precursor mass selection windows have different window widths, and instructing the tandem mass spectrometer to perform fragmentation scans at the two or more adjacent wide precursor mass selection windows across the entire mass range of interest of the each sample by independently controlling the RF voltages and DC voltages of the quadrupole mass filter of the tandem mass spectrometer using the tandem mass spectrometry module.

10. The computer program product of claim 9, wherein the plurality of samples are injected by the fast sample introduction device.

11. The computer program product of claim 9, further comprising instructing the tandem mass spectrometer to vary at least one parameter of the tandem mass spectrometer between at least two of the two or more adjacent wide precursor mass selection windows using the tandem mass spectrometry module.

* * * * *